US007628450B2

(12) United States Patent
Castagnola et al.

(10) Patent No.: US 7,628,450 B2
(45) Date of Patent: Dec. 8, 2009

(54) COLLAPSIBLE CHAIR

(75) Inventors: Dennis A. Castagnola, West Linn, OR (US); Steven J. Paventy, Sandy, OR (US)

(73) Assignee: The Coast Distribution System, Inc., Morgan Hill, CA (US)

( * ) Notice: Subject to any disclaimer, the term of this patent is extended or adjusted under 35 U.S.C. 154(b) by 207 days.

(21) Appl. No.: 11/517,235

(22) Filed: Sep. 5, 2006

(65) Prior Publication Data

US 2008/0054686 A1 Mar. 6, 2008

(51) Int. Cl.
*A47C 4/00* (2006.01)

(52) U.S. Cl. ..... 297/38; 297/39; 297/40; 297/35; 297/16.1

(58) Field of Classification Search ..... 297/16.1, 297/30, 31, 35, 38, 39, 40
See application file for complete search history.

(56) References Cited

U.S. PATENT DOCUMENTS

| | | | | | |
|---|---|---|---|---|---|
| 2,195,091 | A * | 3/1940 | Lorenz et al. | ..... | 297/27 |
| 2,638,970 | A * | 5/1953 | Harber | ..... | 297/39 |
| 4,072,341 | A * | 2/1978 | Kurz | ..... | 297/27 |
| 4,433,870 | A * | 2/1984 | Bairen et al. | ..... | 297/16.1 |
| 5,570,926 | A * | 11/1996 | Papiernik et al. | ..... | 297/39 |
| 5,727,897 | A | 3/1998 | Liu | | |
| 5,845,969 | A | 12/1998 | Grimaldi et al. | | |
| 5,913,572 | A | 6/1999 | Grimaldi et al. | | |
| 6,030,032 | A | 2/2000 | Tseng | | |
| 6,692,068 | B1 * | 2/2004 | Tang | ..... | 297/16.2 |
| 6,755,463 | B2 * | 6/2004 | Lardieri et al. | ..... | 297/35 |
| 6,789,557 | B1 * | 9/2004 | Wahl, Jr. | ..... | 135/154 |
| 6,817,661 | B2 | 11/2004 | Zheng | | |
| 6,902,231 | B1 * | 6/2005 | Tseng | ..... | 297/27 |
| 6,966,564 | B2 * | 11/2005 | Hernandez, Jr. | ..... | 280/32.6 |
| 7,063,380 | B1 * | 6/2006 | Cui | ..... | 297/30 |
| 7,185,948 | B2 * | 3/2007 | Liu | ..... | 297/30 |
| 7,243,990 | B1 * | 7/2007 | Wahl et al. | ..... | 297/184.15 |
| 2002/0125745 | A1 * | 9/2002 | Lee | ..... | 297/30 |

* cited by examiner

*Primary Examiner*—Laurie K Cranmer
(74) *Attorney, Agent, or Firm*—Kolisch Hartwell, P.C.

(57) ABSTRACT

The present disclosure relates to collapsible chairs in which the backrest, seat, and legrest portions can be folded into a relatively compact configuration. The present disclosure provides a collapsible chair including a backrest having an upper portion and a lower portion, a legrest having an upper portion and a lower portion, a seat having a forward end and a rearward end, wherein the rearward end of the seat is functionally connected to the lower portion of the backrest and the forward end of the seat is functionally connected to the upper portion of the legrest, an armrest including an armrest bar, and a foldable base of support, wherein a seat slide fixed on the foldable base of support is configured for sliding interaction with a side bar of the seat.

20 Claims, 6 Drawing Sheets

COLLAPSIBLE CHAIR

BACKGROUND

Collapsible easy chairs are commonly used in leisure situations within and without the home, and can be designed such that they may be folded into a compact configuration and moved to a new location. Collapsible easy chairs often include various articulated joints and may include one of many different types of locking mechanisms. As well, they may include more or less seating area, ranging from a simple seat-only design, to a complex chaise lounge design.

A collapsible chair may include a seat, a backrest, and a legrest, all supported on a base. The body-support portion of a collapsible chair, generally including the seat, backrest, and legrest may be constructed of a relatively flexible material, such as synthetic or natural fiber webbing, or it may be constructed of a harder material, such as a form of plastic or wood.

One example of a collapsible easy chair is described in U.S. Pat. No. 5,570,926 issued to Papiernik et al., which discloses a chaise lounge-type chair that folds into and out of a relatively compact configuration. According to the Papiernik disclosure, an easy chair includes an elongated body support including backrest, seat, and legrest portions connected to flexible webbing upon which a person may sit or recline. The chair of Papiernik includes a number of hinged joints and a number of sliding joints. Given the arrangement of the chair joints and a manual locking mechanism, the chair of Papiernik may be unfolded or refolded in two distinct stages: a base-only stage, in which only the legs may be moved; and a chair-only stage, in which the backrest, seat, and legrest, and any included armrest, may be moved independently of the base.

In view of the prior art described above, a need exists for a collapsible chair having substantial stability when assembled, yet which may be easily reversibly collapsible in a coordinated manner. In addition, an improved chair may provide an easily usable armrest lock that, in combination with other features of the chair, may allow for adjustments to be made to a user's seating position even when a support base of the chair is locked stably in place.

DETAILED DESCRIPTION

Figure 1:
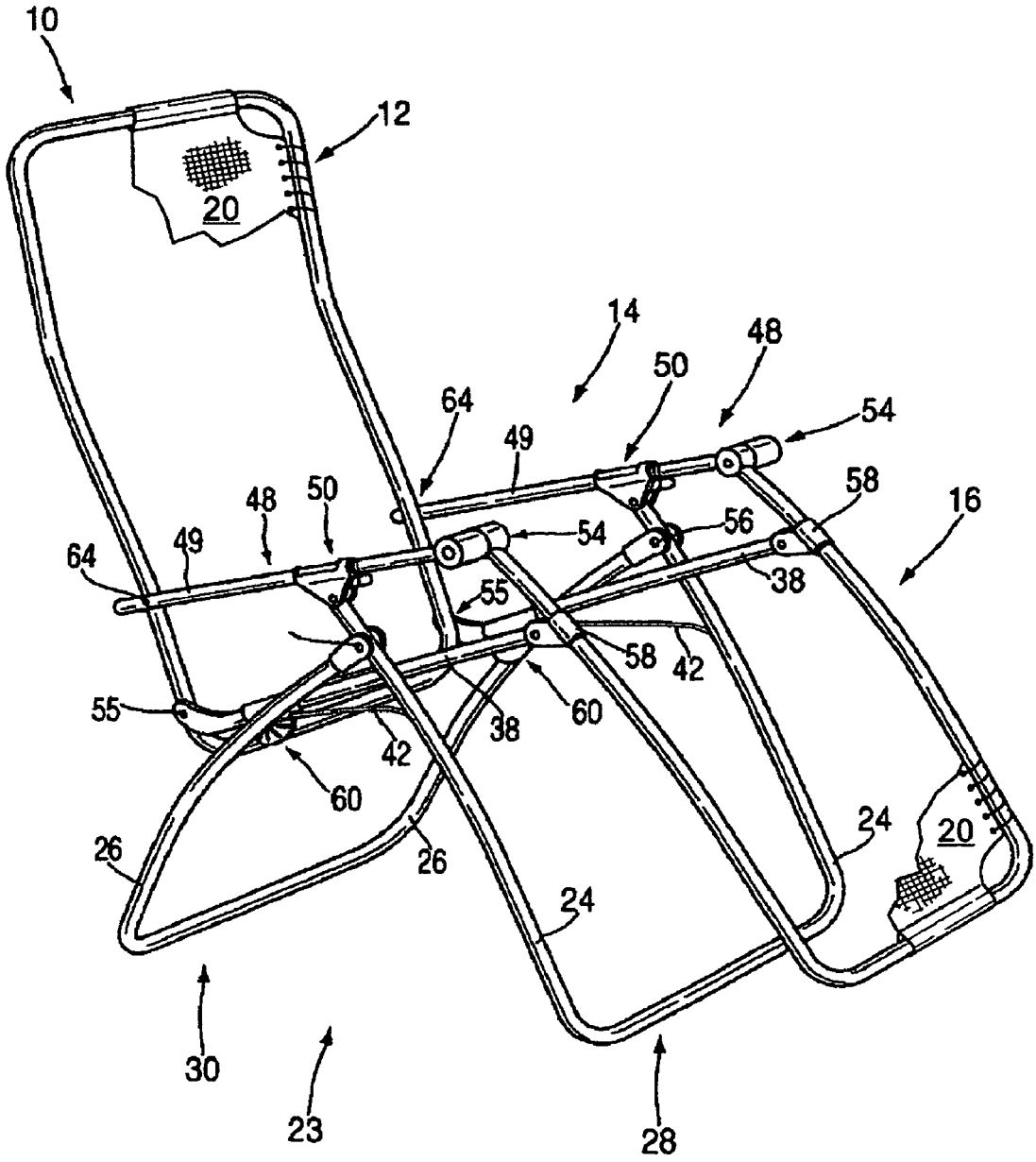
FIG. 1 is a perspective view showing an extended collapsible chair according to aspects of the present disclosure.
Figure 2:
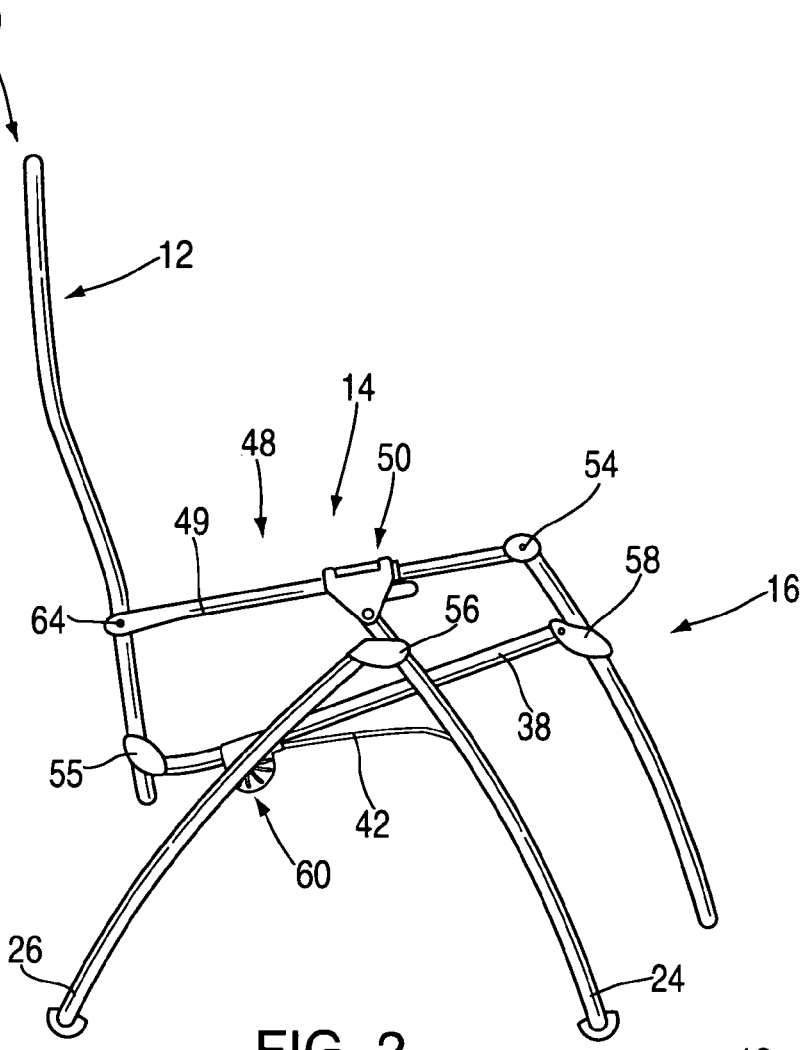
FIG. 2 is a side view showing an extended configuration of the collapsible chair of FIG. 1.
Figure 3:
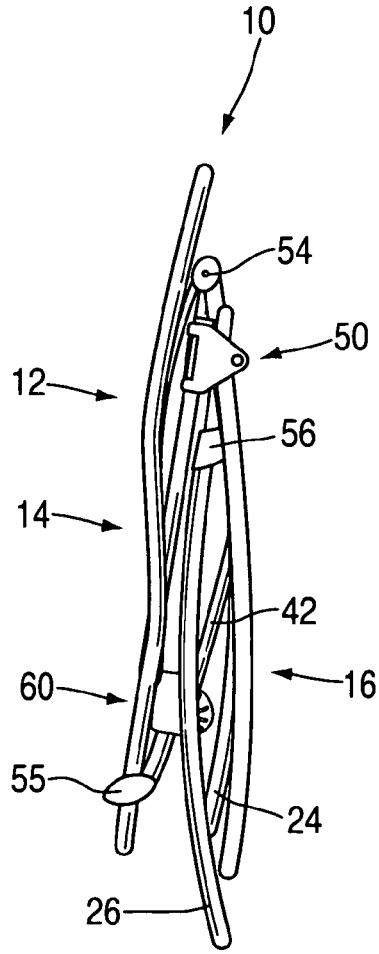
FIG. 3 is a side view showing a collapsed configuration of the collapsible chair of FIG. 1.

FIGS. 1-3 show a collapsible chair in various configurations, the chair being constructed according to aspects of the present disclosure. As seen at various levels of detail in the Figures, a collapsible chair 10 may generally include a backrest 12, a seat 14, and a legrest 16. Together, the backrest, seat portion, and legrest could be considered a body-support portion of the collapsible chair, being the part of a collapsible chair upon which a user of the chair would sit or lay during use of the chair. The body-support portion of the collapsible chair may also include a relatively flexible support material 20 making up a body support surface useful for supporting the body of a user of the chair. Only a partial view of support material 20 is shown in FIG. 1, for the sake of clarity.

While shown as including three body-support subcomponents, the collapsible chair could be constructed, according to the present disclosure, with fewer than all three body-support subcomponents; for example, a collapsible chair could be constructed that includes only the backrest and the seat. Also, although shown in the figures as including a single large, continuous body support mechanism, backrest 12, seat 14, and legrest 16 could be discrete segments of a collapsible chair with gaps between the segments of the support surface.

Backrest 12, seat, 14, and legrest 16, and any included support material, may be constructed of any suitable material for making a chair of sufficient strength to support a human user of the chair. For example, the backrest, seat, and legrest may be defined by a frame of metal tubing, or of plastic tubing, or of pieces of wood. In each case, the frame of the chair should be constructed such that the described segments of the chair can be connected via a number of hinges, sliding joints, etc. In the pictured embodiment, the backrest, seat, and legrest are defined at their peripheries by suitable metallic tubing, but other constructions are possible that fulfill the many aspects of the present disclosure.

As noted above, the body-support portion of the chair may include a support material 20 that rests on or otherwise is supported by the backrest, seat, and legrest. For example, support material 20 may be a flexible material such as a synthetic fabric mesh, or leather, or a non-mesh synthetic material, etc. Alternatively, the support material could be a relatively inflexible material such as a relatively stiff synthetic polymer, or a relatively hard natural material, etc. In some embodiments, support material 20 may be constructed of a material that is resistant to the elements, for use in an outdoor environment. Of course, many suitable support materials are possible, including varied types of fabric, or supports made from wood, metal, etc. In any case, the support material may be held to the body support portions of the chair by, for example, a removable attachment mechanism of some sort, like a cord or webbing, or the material may be nonremovably coupled to the frame, for example by use of one or more rivets.

The body-support portion of the chair, including backrest 12, seat 14, and legrest 16, may be mounted upon a relatively stable base 23, including perhaps a front base 28 and a rear base 30. If present, the front and rear bases may connect to the body-support portion of the chair by a number of front legs 24 and rear legs 26. Alternatively, the legs of the chair may be provided without their connecting bases, with the ends of the legs configured to rest upon the ground or other desired surface of repose.

FIGS. 2 and 3 show that the various components of the body-support portion of the chair, the legs, and the base may be connected by a series of fixed or movable pivot points that allow the chair to be placed into both extended and collapsed configurations. The seat 14 may pivot at both its forward end, via a legrest hinge 58 with the legrest 16, and at its rearward end, via a backrest hinge 55 with the backrest 12. One or more armrests 48 may, likewise pivot relative to the legrest 16 and the backrest 12 via a front armrest hinge 54 and a rear armrest hinge 64, respectively. Finally, the front legs 24 and rear legs 26 may interact at a leg hinge 56.

Some portions of the collapsible chair may interact through a sliding displacement of adjacent structures. The seat side bars 38 may slide relative to the rear legs 26 through placement of the seat side bars 38 within a seat rest slide 60. Likewise, the front legs 24 may each be attached to, and may slide relative to, an armrest 48 at armrest lock 50. To couple movements of the front legs 24 and the seat 14, one or more of the front legs 24 may be connected to a seat side bar 38 by a seat-leg crossbar 42.

Figure 6A:
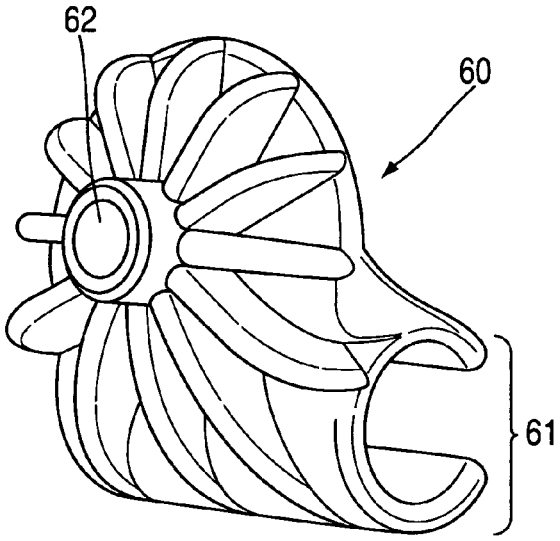
FIGS. 6A and 6B are a pair of close-up views of a pivot mechanism for a collapsible chair, according to aspects of the present disclosure.
Figure 6B:
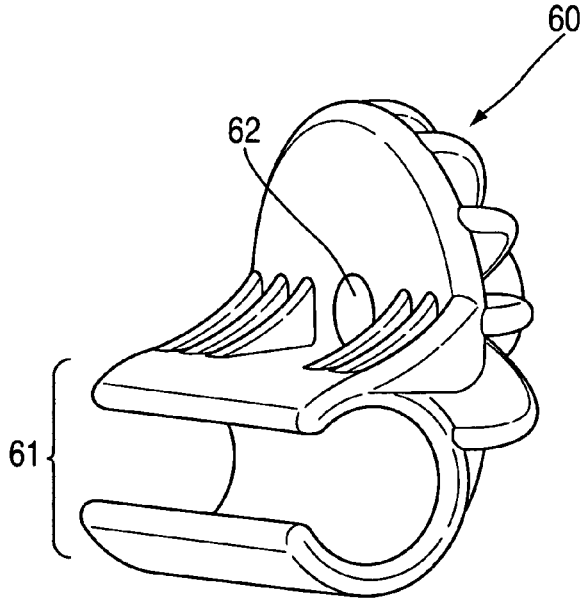

FIGS. 6A and 6B show two views of a seat rest slide 60 that may be used operatively to connect a seat side bar 38 to a rear leg 26. The seat rest slide 60 may include an element, such as a seat slide shell 61, which allows relative movement between two portions of the chair and it may include an element, such as a seat slide pivot 62, which is fixedly attached to a portion of the chair. In the pictured embodiment, the seat rest slide 60 is fixed via seat slide pivot 62 to a rear leg 26 of the chair. The seat slide shell 61 substantially encircles a seat side bar 38. Thus, in the pictured embodiment, seat side bar 38 may slide past the rear leg 26 during manipulation of the configuration of the chair.

Figure 4:
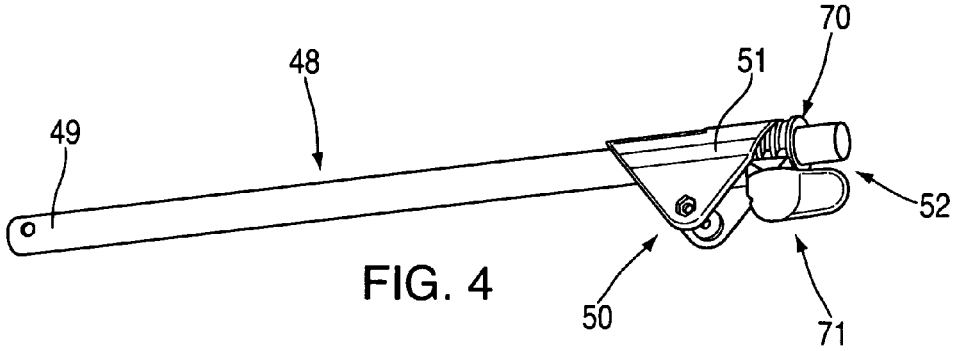
FIG. 4 is a perspective view of an armrest and associated structural and locking members, according to aspects of the present disclosure.

Looking back to FIGS. 1-3, armrest lock 50 may allow sliding movement between an armrest 48 and a front leg 24; armrest lock 50 may also serve to lock the collapsible chair into an established configuration. As well, though the pictured embodiment shows the armrest lock 50 interacting with an armrest bar 49 and a front leg 24, other armrest lock-mediated couplings are possible. FIG. 4 shows a view of an assembly including an armrest 48 and an armrest lock 50. A close-up view of the armrest lock can be seen in FIG. 5, and details of components of the armrest lock can be seen in FIGS. 7A-7C.

FIG. 4 shows that an armrest 48 may be supported by an armrest bar 49. In sliding engagement with the armrest bar 49 may be an armrest lock 50. By "sliding engagement with," it is meant that the armrest lock 50 may include a central opening 80 that is of a shape generally complementary to the shape of the armrest bar 49, such that the armrest bar 49 may move relatively freely through the opening in the armrest lock 50. In the example shown, as in FIGS. 7A-7C, the armrest bar 49 is of generally circular cross-section and the bar opening 80 in the armrest lock 50, too, is of a generally circular cross-section. Though it is possible that the armrest bar 49 and the bar opening 80 may have different cross-sectional shapes and/or areas, a relatively close fit between substantially similar cross-sectional shapes may allow the armrest lock 50 to perform another function: the armrest lock may fix reversibly the collapsible chair in a given configuration.

Figure 5:
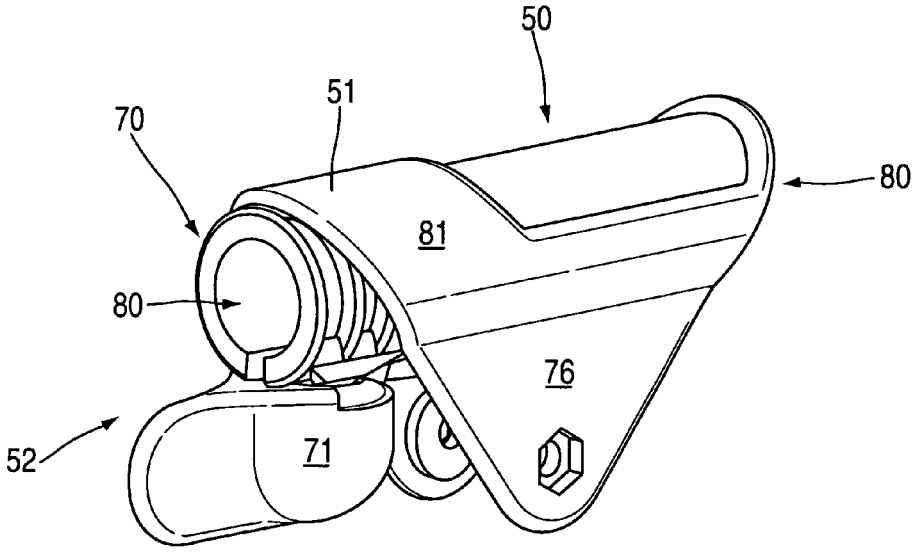
FIG. 5 is a perspective view of a slide and locking mechanism for a collapsible chair, according to aspects of the present disclosure.

As seen in FIG. 5, an armrest lock 50 may include a number of components, including a lock shell 51 and a lock engagement member 52. The lock engagement member 52, in turn, may include a bar clamp 70, and a clamp lock 71. Though shown as multiple components, it is possible that at least the armrest lock 50 and the lock engagement member 52 could be manufactured as a single component while maintaining their combined function.

Figure 7A:
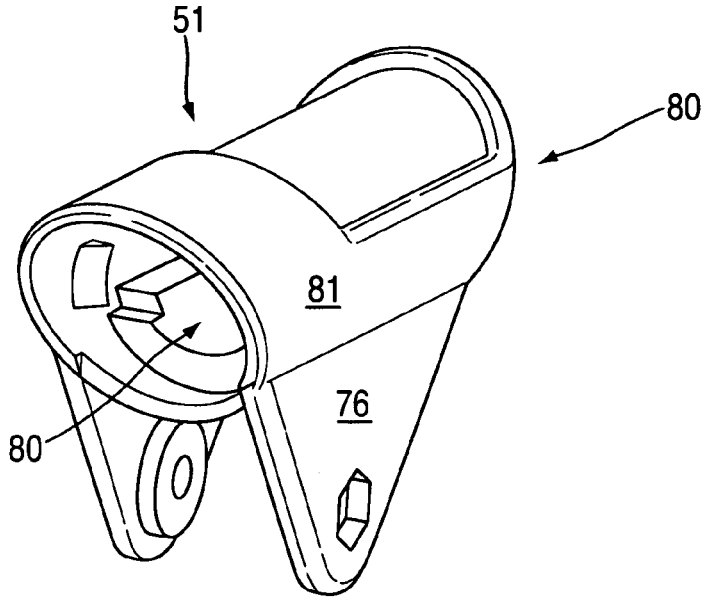
FIGS. 7A, 7B, and 7C are a series of close-up views of components of the slide and locking mechanism of FIG. 5.
Figure 7B:
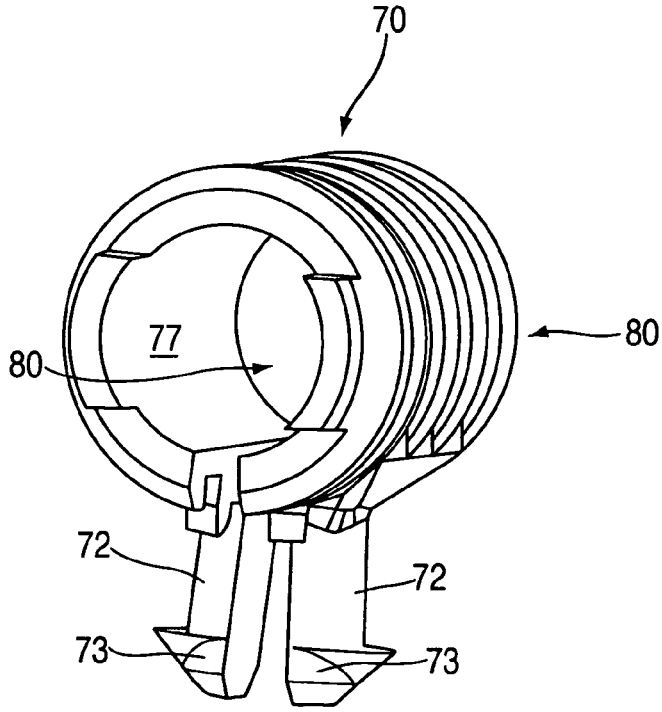
Figure 7C:
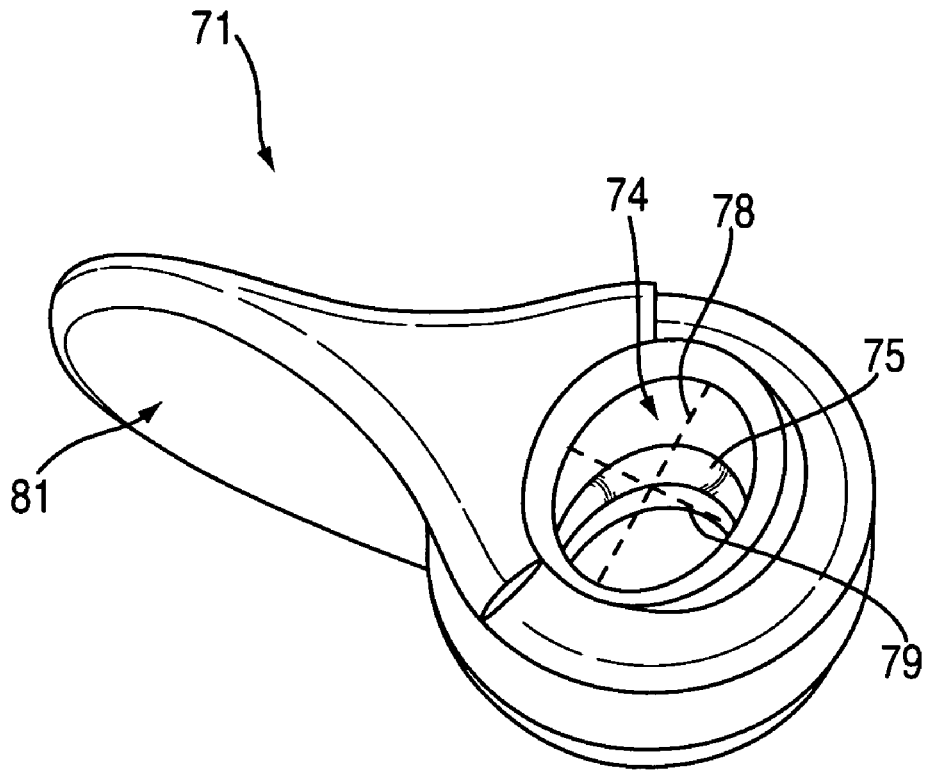

In FIGS. 7A-7C, individually-constructed components of armrest lock 50 are depicted. FIG. 7A shows a lock shell 51, FIG. 7B shows a bar clamp 70, and FIG. 7C shows a clamp lock 71. As seen in FIG. 7A, lock shell 51 may serve to house the components of lock engagement member 52. As well, lock shell 51 may include both fixed and movable engagement portions. A fixed engagement portion 76 of the lock shell may be a location at which the lock shell is attached to, for example, an upper portion of a front leg 24 of the chair. Fixed engagement portion 76 of lock shell 51 may be configured to rest on opposite sides of the upper part of a front leg 24, and it may be fastened to the front leg by a bolt passing through both the front leg and the fixed engagement portion. A movable engagement portion 81 of the lock shell may define armrest bar opening 80. The armrest bar opening may be an opening through which armrest bar 49 may pass and through which the bar may move relatively freely. As noted before, in the depicted embodiment both armrest bar 49 and armrest bar opening 80 have generally circular cross-sectional areas, though other configurations are possible.

As shown in the pictures of the described embodiment, an armrest bar clamp 70 may be held at least partially within lock shell 51. Armrest bar clamp 70 may function reversibly to fix the relationship between an armrest bar 49 and a lock engagement member 52 through which it passes. Armrest bar clamp may include a clamp shell 77, clamp projections 72, and projection tabs 73. A central portion of armrest bar clamp 70 may be configured as including an armrest bar opening 80. In its operative configuration, clamp shell 77 may be at least partially inserted into lock shell 51, as seen most clearly in FIG. 5, such that the armrest bar openings 80 of the lock shell 51 and the clamp shell 77 are substantially aligned, allowing an armrest bar 49 to reside within and pass relatively unrestricted through the openings. Clamp shell 77 may have a bar opening 80 sized differently than the bar opening 80 of lock shell 51, but the size of the opening of clamp shell 77 may be configured to be reversibly constricted or expanded through the operation of a clamp lock 71, shown in detail in FIG. 7C. As such, the clamp shell may serve reversibly to restrict movement between at least first and second movable portions of the chair. For example, first and second moveable portions may be an armrest bar and a leg, or an armrest bar and a lock engagement mechanism, or any other suitable pair of movable portions of the collapsible chair.

Clamp lock 71 makes up, in the depicted embodiment, a lower portion of lock engagement member 52, as seen in FIGS. 4 and 5. In this orientation, clamp lock 71 may be relatively easily accessed by a hand of a user of the described collapsible chair. Operation of clamp lock 71 may occur by a user grasping or otherwise manipulating the clamp lock through contact with a clamp tab 81. As seen in FIG. 7C, clamp lock 71 may include a lock insertion site 74 and a tab slot 75. Lock insertion site 74 may be a location into which clamp projections 72 may fit, allowing for a relatively stable, rotational interaction to be maintained between the clamp lock 71 and bar clamp 70. In the depicted embodiment, tab slot 75 within lock insertion site 74 has the form of a generally annular slot into which projection tabs 73 may insert, resulting in a substantially permanent association between clamp lock 71 and bar clamp 70. As is also apparent from FIG. 7C, lock insertion site 74 may not be formed with a generally circular cross-sectional area.

In a depicted embodiment, lock insertion site 74 may have a generally oval cross-sectional area, such that a cross-sectional profile of lock insertion site 74 has both a long axis 78 and a short axis 79. In an initial configuration, clamp lock 71 may be attached to bar clamp 70 such that clamp projections 72 rest against the inner sides of lock insertion 74 at either end of long axis 78. In such an arrangement, which could be termed an "unlocked" configuration, bar opening 80 of clamp shell 77 may be in its most open position, allowing free sliding movement of any inserted armrest bar 49. A depiction of this arrangement can be seen in FIGS. 4 and 5. In a second arrangement, which could be termed a "locked" configuration, clamp lock 71 may be oriented such that clamp projections 72 of clamp shell 77 rest against the inner sides of lock insertion site 74 at either end of short axis 79. In the locked configuration, a dimension of bar opening 80 of clamp shell 77 may be altered in a defined manner. As one example, bar opening 80 may assume a more closed position in the locked configuration (i.e. its cross-sectional area, or diameter may be reduced) than is present in the unlocked configuration; the locked configuration of bar opening 80 may prevent free sliding movement of any inserted armrest bar. Although many locking/unlocking motions are possible, in the described embodiment, locking and unlocking the armrest lock occurs via a simple rotational motion of clamp lock 71 around inserted clamp projections 72.

Depending on the construction of the various parts of a collapsible chair, locking the lock engagement member in the above-described manner may prevent movement of the entirety of the chair, or only a portion of the chair. In the depicted embodiment, locking the lock engagement member prevents movement of the body-support portion of the collapsible chair; the base of the chair, including the legs and any other provided support surfaces, may be free to move to various degrees. During operation of the chair depicted in the Figures, engagement of armrest lock 50 fixes the relationship between an armrest bar 49 and a front leg 24. However, because seat side bar 38 is in a second sliding relationship with rear leg 26, and this relationship is not fixed by the armrest lock, some adjustment may be made in the position of the chair even though the armrest and front leg are fixed relative to one another.

Having described some of the many components making up a collapsible chair according to aspects of the present disclosure, there remains to describe some way of using the described chair. A user may initially find the collapsible chair 10 in a collapsed configuration, as shown in FIG. 3, and may desire to extend the chair into a more open configuration, like that shown in FIGS. 1 and 2. The user may initially check to be sure that the lock engagement member 52 is in an unlocked configuration. Upon verifying that the chair is capable of being opened, the user may grasp the chair at the front legs 24 and rear legs 26 or at the legrest 16 and backrest 12, or another suitable pair of positions. By moving apart two elements of the chair that are adjacent in the collapsed configuration, the user may extend the chair in a coordinated manner. The user may initially bring the front legs 24 and the rear legs 26 to their most spaced apart configuration, providing the widest base of support for further use of the chair.

Once a base for the chair has been established, a user may adjust the body support portion of the chair, including the backrest 12, seat 14, and legrest 16, to any desired configuration. For example, the user may wish to be relatively reclined, in which case the backrest 12, seat 14, and legrest 16 will assume an extended configuration, where the seat is substantially horizontal and the backrest and legrest form a small angle with a horizontal plane. For instance, the backrest and legrest may form a 45-degree angle from the horizontal, or a 30-degree angle with the horizontal, etc. As another example, the user may wish to be relatively upright, in which case the backrest, seat, and legrest may assume a more compact configuration, where the seat is substantially horizontal, and the backrest and legrest form approximately right angles with a horizontal plane.

When the user has established a desired configuration of the collapsible chair, the user may lock the chair into that configuration. To do so, the user may engage a lock engagement member 52 in an armrest lock that restricts movement between at least two portions of the collapsible chair. In the depicted embodiment, a user manipulates clamp tab 81 to rotate clamp lock 71 from an unlocked to a locked position and, thus, locks together at least one front leg 24 and an armrest bar 49. When the chair is locked into place, with the armrest secured relative to the legs (in the depicted embodiment), the user may sit in the chair.

Though the chair may immediately be used when locked, the user may also fine tune the position of the body support portion of the chair even after the armrest has been locked into place. As can be seen in the Figures, both the armrest support bar and the seat rest side bars are in sliding relationships with hinges to which they attach. Because engaging the lock engagement mechanism on the armrest reversibly fixes only one of these two sliding relationships, a user could still fine tune the seat position by manipulating the second sliding relationship. Notably, such manipulation can occur without changing the relative spacing of the legs of the base, which allows a stably established base of support for the chair to be maintained.

While the invention has been disclosed in its preferred form, the specific embodiments thereof as disclosed and illustrated herein are not to be considered in a limiting sense as numerous variations are possible. Applicant regards the subject matter of the invention to include all novel and non-obvious combinations and subcombinations of the various elements, features, functions and/or properties disclosed herein. No single feature, function, element or property of the disclosed embodiments is essential. The following claims define certain combinations and subcombinations which are regarded as novel and non-obvious. Other combinations and subcombinations of features, functions, elements and/or properties may be claimed through amendment of the present claims or through presentation of new claims in this or a related application. Such claims, whether they are broader, narrower or equal in scope to the original claims, are also regarded as included within the subject matter of applicant's invention.

What is claimed is:

1. A collapsible chair, comprising:

a backrest having an upper portion and a lower portion;

a legrest having an upper portion and a lower portion;

a seat having a forward end and a rearward end, wherein the rearward end of the seat is functionally connected to the lower portion of the backrest and the forward end of the seat is functionally connected to the upper portion of the legrest;

an armrest including an armrest bar;

a foldable base of support, and a seat slide fixed on the foldable base of support, wherein the seat slide includes a substantially cylindrical shell through which a side bar of the seat is configured to slide.

2. The chair of claim 1 wherein the functional connection between the seat and at least one of the backrest and the legrest is a direct pivotal connection.

3. The chair of claim 2 wherein the functional connections between the seat and both of the backrest and the legrest are direct pivotal connections.

4. The chair of claim 1 further comprising:

a manually operable locking mechanism configured reversibly to restrict movement between at least first and second movable portions of the chair.

5. The chair of claim 4 wherein the manually operable locking mechanism is configured reversibly to restrict movement of the armrest relative to another portion of the chair.

6. The chair of claim 5 wherein the manually operable locking mechanism restricts a sliding relationship between the foldable base of support and the armrest.

7. The chair of claim 6 wherein the manually operable locking mechanism comprises a lock engagement member including a clamp shell having one or more clamp projections and a clamp lock having an insertion site, with a long axis and a short axis, wherein the one or more clamp projections are configured to reside at least partially within the insertion site, wherein the clamp lock is configured to alter a dimension of the clamp shell and further wherein in a locked configuration of the clamp shell the clamp projections are aligned with the short axis of the insertion site.

8. The chair of claim 1 further comprising a cross member having two ends, wherein a first end of the cross member is connected to the foldable base of support, and a second end of the cross member is directly coupled to a seat bar such that coordinated motion between the foldable base of support and the seat bar is possible.

9. The chair of claim 1 further comprising a substantially continuous body support surface at least partially supported by the backrest, seat, and legrest.

10. The chair of claim 9 wherein the substantially continuous body support surface comprises a flexible material.

11. The chair of claim 9 wherein the substantially continuous body support surface comprises a relatively inflexible material and the relatively inflexible material is configured to accommodate collapse of the chair.

12. A method of using a collapsible chair, the collapsible chair comprising a backrest having an upper portion and a lower portion;

a legrest having an upper portion and a lower portion; a seat having a seat bar; an armrest; and a foldable base of support, the method comprising:

grasping a chair having a first configuration;

arranging the chair into a second configuration, wherein arranging the chair includes sliding the seat bar through a seat slide fixed on the foldable base of support, and wherein the seat slide includes a substantially cylindrical shell through which the seat bar is configured to slide; and locking the chair into the second configuration.

13. The method of claim 12 wherein the step of locking the chair includes the step of engaging a manually operable locking mechanism.

14. The method of claim 13 wherein the manually operable locking mechanism is configured to restrict movement between at least first and second movable portions of the chair.

15. The method of claim 12 wherein the step of locking the chair includes locking the chair such that the seat of a locked chair may be adjusted.

16. The method of claim 12 wherein the first configuration is a collapsed configuration and the second configuration is an extended configuration.

17. The method of claim 12 wherein the first configuration is an extended configuration and the second configuration is a collapsed configuration.

18. A collapsible chair, comprising:

a backrest having an upper portion and a lower portion;

a legrest having an upper portion and a lower portion;

a seat having a forward end, a rearward end, and a side bar, wherein the rearward end of the seat is functionally connected to the lower portion of the backrest and the forward end of the seat is functionally connected to the upper portion of the legrest;

an armrest including an armrest bar;

a seat slide configured for sliding interaction with the side bar of the seat, wherein the seat slide includes a substantially cylindrical shell through which the side bar of the seat is configured to slide;

a foldable base of support, wherein the seat slide is fixed on the foldable base of support; and a manually operable locking mechanism, wherein the manually operable locking mechanism comprises a lock engagement member including a clamp shell having one or more clamp projections and a clamp lock having an insertion site, with a long axis and a short axis, wherein the one or more clamp projections are configured to reside at least partially within the insertion site, wherein the clamp lock is configured to alter a dimension of the clamp shell and further wherein in a locked configuration of the clamp shell the clamp projections are aligned with the short axis of the insertion site.

19. A collapsible chair, comprising:

a backrest having an upper portion and a lower portion;

a legrest having an upper portion and a lower portion;

a seat having a forward end and a rearward end, wherein the rearward end of the seat is functionally connected to the lower portion of the backrest and the forward end of the seat is functionally connected to the upper portion of the legrest;

an armrest including an armrest bar;

a foldable base of support, wherein a seat slide fixed on the foldable base of support is configured for sliding interaction with a side bar of the seat; and a cross member having two ends, wherein a first end of the cross member is pivotably connected to the foldable base of support, and a second end of the cross member is directly pivotably coupled to the side bar of the seat to effect coordinated motion between the foldable base of support and the seat bar upon folding of the chair.

20. The chair of claim 19 further comprising:

a manually operable locking mechanism, wherein the manually operable locking mechanism comprises a lock engagement member including a clamp shell having one or more clamp projections and a clamp lock having an insertion site with a long axis and a short axis, wherein the one or more clamp projections are configured to reside at least partially within the insertion site, wherein the clamp lock is configured to alter a dimension of the clamp shell and further wherein in a locked configuration of the clamp shell the clamp projections are aligned with the short axis of the insertion site.

* * * * *